US010780697B2

(12) United States Patent
Chen et al.

(10) Patent No.: US 10,780,697 B2
(45) Date of Patent: Sep. 22, 2020

(54) FLUID EJECTION DIES

(71) Applicant: HEWLETT-PACKARD DEVELOPMENT COMPANY, L.P., Spring, TX (US)

(72) Inventors: Chien-Hua Chen, Corvallis, OR (US); Michael W Cumbie, Corvallis, OR (US); James R Przybyla, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/464,639

(22) PCT Filed: Mar. 15, 2017

(86) PCT No.: PCT/US2017/022522
§ 371 (c)(1),
(2) Date: May 28, 2019

(87) PCT Pub. No.: WO2018/169525
PCT Pub. Date: Sep. 20, 2018

(65) Prior Publication Data

US 2019/0389220 A1 Dec. 26, 2019

(51) Int. Cl.

| | |
|---|---|
| ***B41J 2/16*** | (2006.01) |
| ***B41J 2/14*** | (2006.01) |
| ***B41J 2/175*** | (2006.01) |
| ***B41J 29/377*** | (2006.01) |

(52) U.S. Cl.
CPC ..... *B41J 2/1603* (2013.01); *B41J 2/1408* (2013.01); *B41J 2/14145* (2013.01); *B41J 2/1637* (2013.01); *B41J 2/17546* (2013.01); *B41J 29/377* (2013.01)

(58) Field of Classification Search
CPC ..... B41J 2/1637; B41J 29/377; B41J 2/1408
See application file for complete search history.

(56) References Cited

U.S. PATENT DOCUMENTS

| | | | | |
|---|---|---|---|---|
| 6,074,035 | A | 6/2000 | Irizawa et al. | |
| 6,280,013 | B1 | 8/2001 | Wade et al. | |
| 6,819,562 | B2 | 11/2004 | Boudreaux | |
| 6,820,959 | B1 * | 11/2004 | Spitz | B41J 2/14024 347/18 |
| 7,887,153 | B2 | 2/2011 | Takata | |
| 8,033,642 | B2 | 10/2011 | Shihoh et al. | |

(Continued)

FOREIGN PATENT DOCUMENTS

| | | |
|---|---|---|
| CN | 202046012 | 11/2011 |
| CN | 103240993 | 8/2013 |

(Continued)

OTHER PUBLICATIONS

Silicon MEMS Printhead FAQ, Nov. 22, 2016, <http://imieurope.com/inkjet-blog/2016/11/22/silicon-mems-printhead-faq>.

*Primary Examiner* — Julian D Huffman
(74) *Attorney, Agent, or Firm* — Fabian VanCott

(57) ABSTRACT

A fluid ejection device may include a fluid ejection die embedded in a moldable material, and a number of heat exchangers thermally coupled to an ejection side of the fluid ejection die. Further, the fluid ejection device may include a number of cooling channels defined in the moldable material thermally coupled to the heat exchangers.

15 Claims, 11 Drawing Sheets

(56) References Cited

U.S. PATENT DOCUMENTS

| | | | | |
|---|---|---|---|---|
| 9,162,453 | B2 | 5/2015 | Cruz-Uribe et al. | |
| 9,423,188 | B2 | 8/2016 | Paschkewitz et al. | |
| 2003/0189622 | A1 | 10/2003 | Giere | |
| 2005/0024457 | A1 | 2/2005 | Hilton et al. | |
| 2005/0110820 | A1 | 5/2005 | Merz | |
| 2009/0141062 | A1* | 6/2009 | Takano | B41J 2/515<br>347/18 |
| 2010/0245486 | A1 | 9/2010 | Ishida | |
| 2011/0205303 | A1 | 8/2011 | Pan | |
| 2011/0227987 | A1 | 9/2011 | Pan et al. | |
| 2013/0010027 | A1 | 1/2013 | Yamada | |
| 2013/0293641 | A1 | 11/2013 | Essen | |
| 2015/0239238 | A1 | 8/2015 | Yamada | |
| 2016/0001465 | A1 | 1/2016 | Chen et al. | |
| 2018/0015732 | A1 | 1/2018 | Chen et al. | |

FOREIGN PATENT DOCUMENTS

| | | | | |
|---|---|---|---|---|
| CN | 103381708 | | 11/2013 | |
| CN | 105189122 | | 12/2015 | |
| EP | 0870622 | | 10/1998 | |
| EP | 1124691 | | 8/2001 | |
| EP | 2961611 | | 1/2016 | |
| JP | 2006056240 | | 3/2006 | |
| JP | 2007168112 | | 7/2007 | |
| KR | 20070011787 | | 1/2007 | |
| WO | WO-0024584 | | 5/2000 | |
| WO | WO-2011146149 | | 11/2011 | |
| WO | WO-2014133577 | | 9/2014 | |
| WO | WO-2016032497 | A1 * | 3/2016 | B41J 2/1603 |
| WO | WO-2016193238 | | 12/2016 | |

* cited by examiner

FLUID EJECTION DIES

BACKGROUND

A fluid ejection die in a fluid cartridge or print bar may include a plurality of fluid ejection elements on a surface of a silicon substrate. By activating the fluid ejection elements, fluids may be printed on substrates. The fluid ejection die may include resistive elements used to cause fluid to be ejected from the fluid ejection die.

BRIEF DESCRIPTION OF THE DRAWINGS

The accompanying drawings illustrate various examples of the principles described herein and are a part of the specification. The illustrated examples are given merely for illustration, and do not limit the scope of the claims.

Figure 1A:
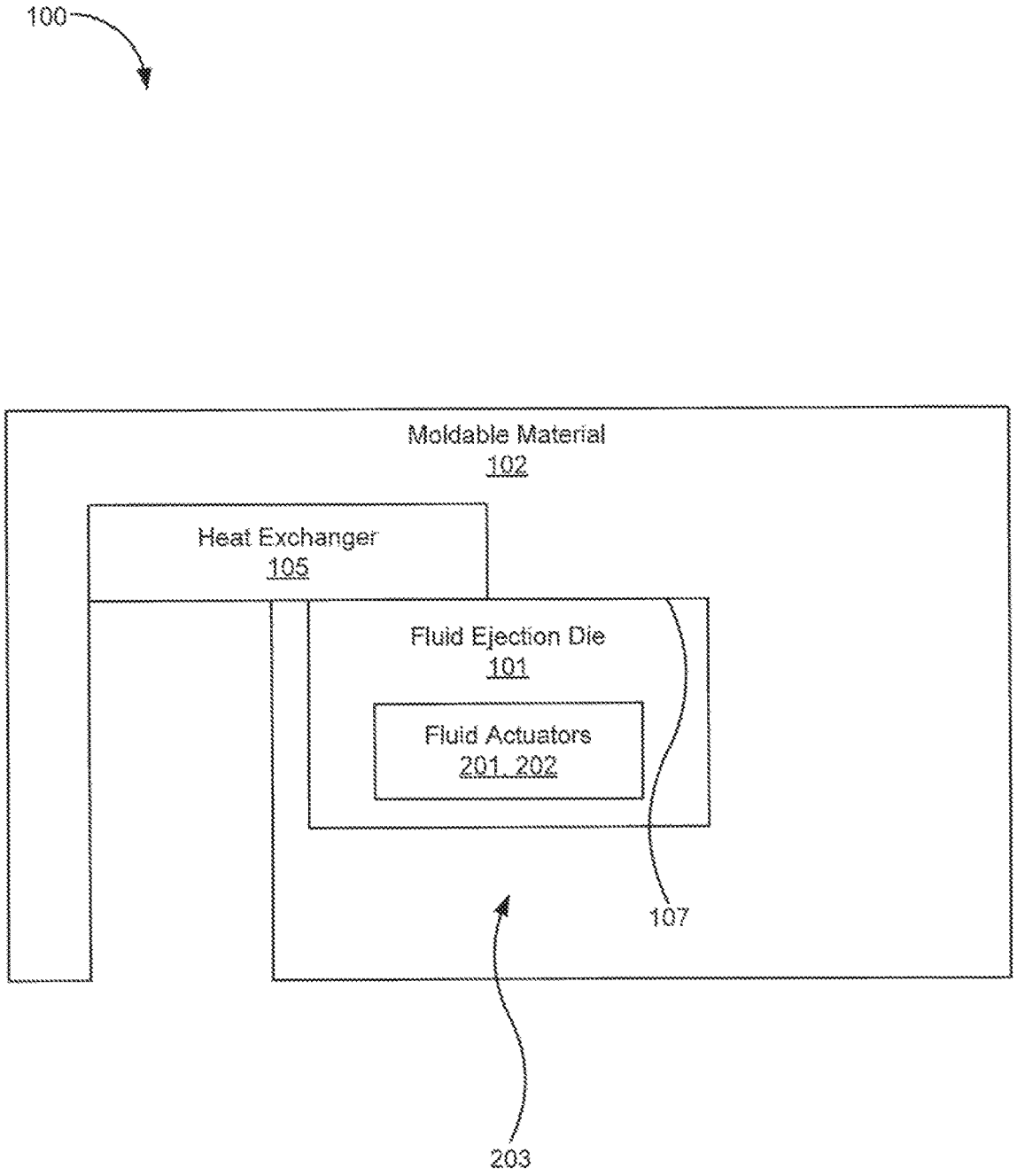
FIG. 1A is a block diagram of a fluid flow structure, according to one example of the principles described herein.

Throughout the drawings, identical reference numbers designate similar, but not necessarily identical, elements. The figures are not necessarily to scale, and the size of some parts may be exaggerated to mere clearly illustrate the example shown. Moreover, the drawings provide examples and/or implementations consistent with the description; however, the description is not limited to the examples and/or implementations provided in the drawings.

DETAILED DESCRIPTION

As mentioned above, the fluid ejection die may include resistive elements used to cause fluid to be ejected from the fluid ejection die. In some examples, the fluid may include particles suspended in the fluid that may tend to move out of suspension and collect in certain areas within the fluid ejection die as sediment. In one example, this sedimentation of particles may be corrected by including a number of fluid recirculation pumps to the fluid ejection die. In one example, the fluid recirculation pumps may be pump devices used to reduce or eliminate, for example, pigment settling within an ink by recirculating the ink through the ejection chambers of the fluid ejection die and a number of by-pass fluidic paths.

However, addition of the fluid recirculation pumps along with the fluid ejection resistors may cause an undesirable amount of waste heat to accumulate within fluid, the fluid ejection die, and other portions of the overall fluid ejection device. This increase in waste heat may cause thermal detects in the ejection of the fluid from the fluid ejection die.

Examples described herein provide a fluid ejection device. The fluid ejection device may include a fluid ejection die embedded in a moldable material, a number of fluid recirculation pumps within the fluid ejection die to recirculate fluid within a number of ejection chambers of the fluid ejection die, a number of heat exchangers thermally coupled to an election side of the fluid ejection die, and a number of cooling channels defined in the moldable material thermally coupled to the heat exchangers. The heat exchangers may include a wire, a bond ribbon, a heat pipe, a lead frame, or combinations thereof.

Further, the fluid recirculated by the fluid recirculation pumps within the ejection chambers of the fluid ejection die is present within the cooling channels. The cooling channels convey a cooling fluid. The cooling fluid functioning to transfer heat from the heat exchanger. In one example, the heat exchangers are embedded within the moldable material, and exposed to the cooling channels. Further, in one example, a shroud coupled to an ejection side of the fluid ejection device and thermally coupled to the heat exchangers.

Examples described herein also provide a print bar. The print bar may include a fluid ejection device. The fluid ejection device may include a fluid ejection die embedded in a moldable material, a number of fluid recirculation pumps within the fluid election die to recirculate fluid within a number of ejection chambers of the fluid ejection die, a number of heat exchangers at least partially embedded within the moldable material and thermally coupled to an ejection side of the fluid ejection die, and a number of cooling channels defined in the moldable material thermally coupled to the heat exchangers. In one example, the fluid cartridge may further include a controller to control ejection of the fluid from the fluid ejection die and control the fluid recirculation pumps.

In one example, a recirculation reservoir may be coupled to the print bar for recirculating a cooling fluid through the cooling channels. In one example, the controller controls the recirculation reservoir. Further, in one example, the recirculation reservoir may include a heat exchange device to transfer heat from the cooling fluid. The cooling fluid may be the same as the fluid recirculated within the ejection chambers of the fluid election die. In another example, the cooling fluid may be different than the fluid recirculated within the ejection chambers of the fluid ejection die. In one example, a shroud coupled to an ejection side of the fluid ejection device and thermally coupled to the heat exchangers may also be included in the fluid cartridge.

Examples described herein also provide a fluid flow structure. The fluid flow structure may include a silver die compression molded into a molding, a fluid feed hole extending through the sliver die from a first exterior surface to a second exterior surface, a fluid channel fluidically coupled to the first exterior surface, and a number of heat exchangers at least partially molded into the molding and thermally coupled to the second exterior surface of the fluid ejection die. The fluid flow structure may further include s shroud coupled to the ejection side of the fluid ejection device and thermally coupled to the heat exchangers. Further, a number of cooling channels may be defined in the moldable material thermally coupled to the heat exchangers.

As used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may or may not be included in other examples.

Turning now to the figures, FIG. 1A is a block diagram of a fluid flow structure (100), according to one example of the principles described herein. The fluid ejection device including a fluid ejection die embedded in a moldable material. A number of fluid actuators (201, 202) may be included within the fluid ejection die (101). In one example, the fluid ejection die (101) may comprise a number of fluid actuators. Examples of fluid actuators (201, 202) includes thermal-resistor-based fluid actuators, piezoelectric-membrane-based fluid actuators, other types of fluid actuators, or combinations thereof. In one examples, a fluid actuator (201, 202) may be disposed in an ejection chamber of a nozzle such that fluid may be ejected through a nozzle orifice of the nozzle responsive to actuation of the fluid actuator (201, 202). In such examples, a fluid actuator (201, 202) disposed in an ejection chamber may be referred to as a fluid ejector.

In some examples, a fluid actuator (201, 202) may be disposed in a fluidic channel. In these examples, actuation of the fluid actuator (201, 202) may cause displacement of fluid in the channel (i.e., a fluid flow). In examples in which a fluid actuator (201, 202) is disposed m a fluidic channel, the fluid actuators (201, 202) may be referred to as fluid pumps. In some examples, a fluid actuator (201, 202) may be disposed in a fluid channel coupled to an ejection chamber and through which fluid may recirculate.

Further, a number of heat exchangers (105) may be thermally coupled to an ejection side (107) of the fluid ejection die. A number of cooling channels (203) may be defined in the moldable material (102), and may be thermally coupled to the heal exchangers (105).

Figure 1B:
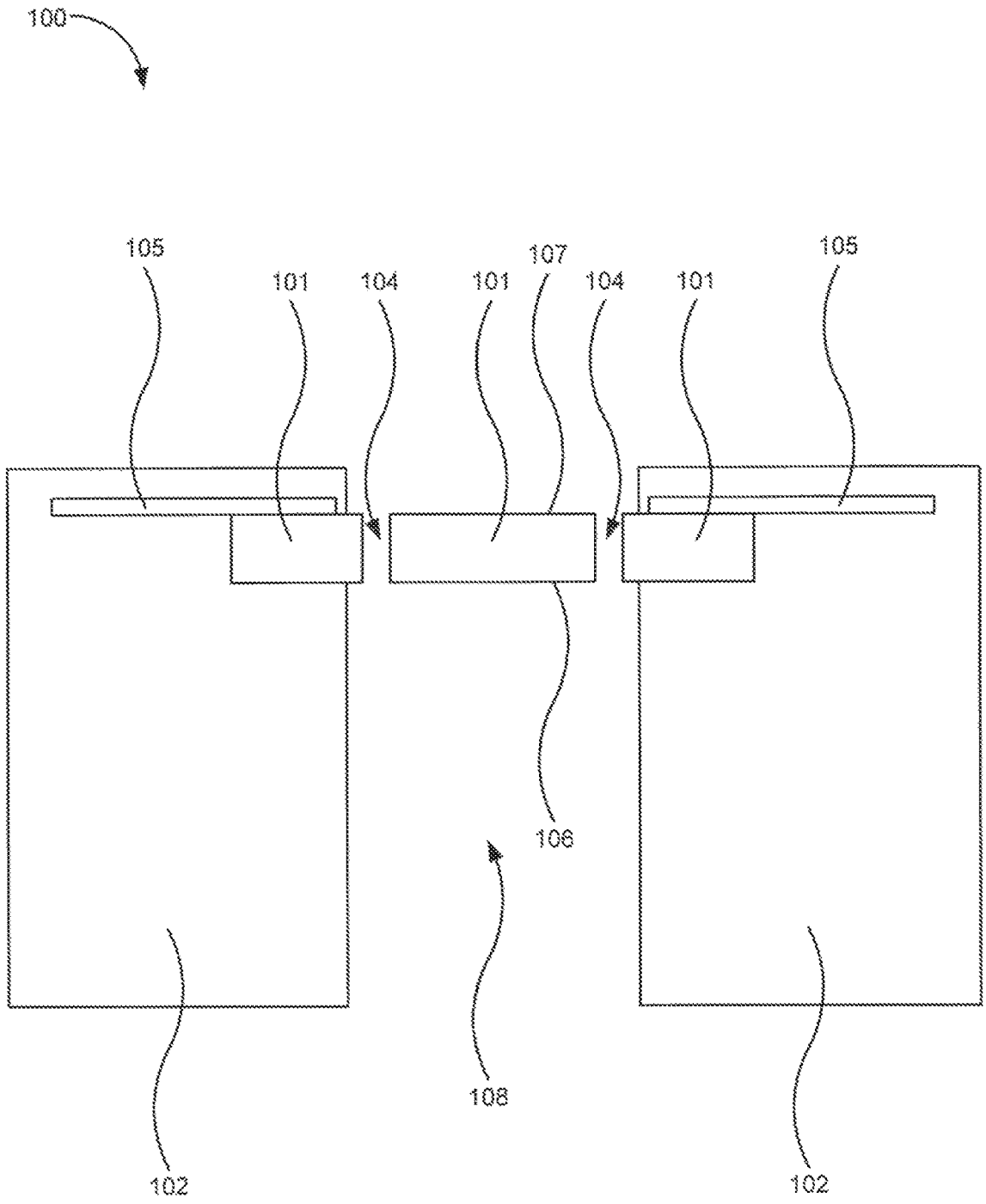
FIG. 1B is an elevation cross-sectional diagram of a fluid flow structure, according to another example of the principles described herein.

FIG. 1B is an elevation cross-sectional diagram of a fluid flow structure (100), according to another example of the principles described herein. A fluid flow structure (100) including those depicted throughout the figures may be any structure through which fluid flows. In one example, the fluid flow structures (100, 200, 300, 400, collectively referred to herein as 100) in, for example, FIGS. 1 through 4 may include a number of fluid ejection dies (101). The fluid ejection dies (101) may be used in, for example, printing fluids onto a substrate. Further, in one example, the fluid flow structures (100) may include fluid ejection dies (101) including, for example, a number of fluid ejection chambers, a number of resistors for healing and ejection the fluid from the ejection chambers, a number of fluid feed holes, a number of fluid passageways, and other elements that assist in the ejection of fluid from the fluid flow structures (100, 200, 300, 400). In still another example, the fluid flow structures (100, 200, 300, 400) may include fluid ejection dies (101) that are thermal fluid-jet dies, piezoelectric fluid-jet dies, other types of fluid-jet dies, or combinations thereof.

In one example, the fluid flow structure (100, 200, 300, 400) includes a number of sliver die (101) compression molded info a moldable material (102). A sliver die (101) includes a thin silicon, glass, or other substrate having a thickness on the order of approximately 860 micrometers (μm) or less, and a ratio of length to width (L/W) of at least three. In one example, the fluid flow structure (100) may include at least one fluid ejection die (101) compression molded into a monolithic body of plastic, epoxy mold compound (EMC), or other moldable material (102). For example, a print bar including the fluid flow structure (100, 200, 300, 400) may include multiple fluid ejection dies (101) molded into an elongated, singular molded body. The molding of the fluid election dies (101) within the moldable material (102) enables the use of smaller dies by offloading the fluid delivery channels such as fluid feed holes and fluid delivery slots from the fluid ejection die (101) to the molded body (102) of the fluid flow structure (100, 200, 300, 400). In this manner, the molded body (102) effectively grows the size of each fluid ejection die (101), which, in turn, improves fan-out of the fluid ejection die (101) for making external fluid connections and for attaching the fluid election dies (101) to other structures.

The fluid ejection device (100) of FIG. 1 may include at least one fluid ejection die (101) such as, for example, a sliver die embedded in the moldable material (102). A number of fluid feed holes (104) may be defined within and extending through the fluid ejection die (101) from a first exterior surface (106) to a second exterior surface (107) in order to allow the fluid to be brought from the back side of the fluid election die (101) to be ejected from the front side. Thus, a fluid channel (108) is defined in the fluid ejection die (101) and fluidically coupled between the first exterior surface (106) and the second exterior surface (107).

A number of heat exchangers (105) may be at least partially molded into the molding material (102). The heat exchangers (105) may be any passive heat exchange device that transfers heat generated by the fluid ejection die (101) to a fluid medium such as air or a liquid coolant. The heat exchangers (105) may be a wire such as a copper wire, a bond ribbon, a heat pipe, a lead frame, other types of heat exchangers, or combinations thereof.

The heat exchangers (105) are thermally coupled to the second exterior surface (107) of the fluid ejection die (101). In this manner, the heat exchangers (105) are able to draw heat generated by, for example, a number of resistors for heating and ejection the fluid from the ejection chambers included within the fluid ejection die (101).

Further, the heat exchangers (105) are able to draw heat generated by a number of fluid recirculation pumps within the fluid ejection die (101). In one example, the fluid recirculation pumps may be any device used to reduce or eliminate, for example, pigment settling within an ejectable fluid such as an ink by recirculating the ejectable fluid through the ejection chambers of the fluid ejection die (101) and a number of by-pass fluidic paths. The fluid recirculation pumps move the ejectable fluid such as the ink through the fluid ejection die (101). In one example, the fluid recirculation pumps may be micro-resistors that create bubbles within the fluid ejection die (101) that force the electable fluid through the ejection chambers and by-pass fluidic paths of the fluid ejection die (101). In another example, the fluid recirculation pumps may be piezoelectrically activated membranes that change the shape of a piezoelectric material when an electric field is applied, and force the ejectable fluid through the ejection chambers and by-pass fluidic paths of the fluid ejection die (101). Actuation of the fluid recirculation pumps and the ejection chamber resistors increases the amount of waste heat generated within the fluid ejection die (101). The heat exchangers (105) are used to draw that heat from the fluid ejection die (101).

Figure 2:
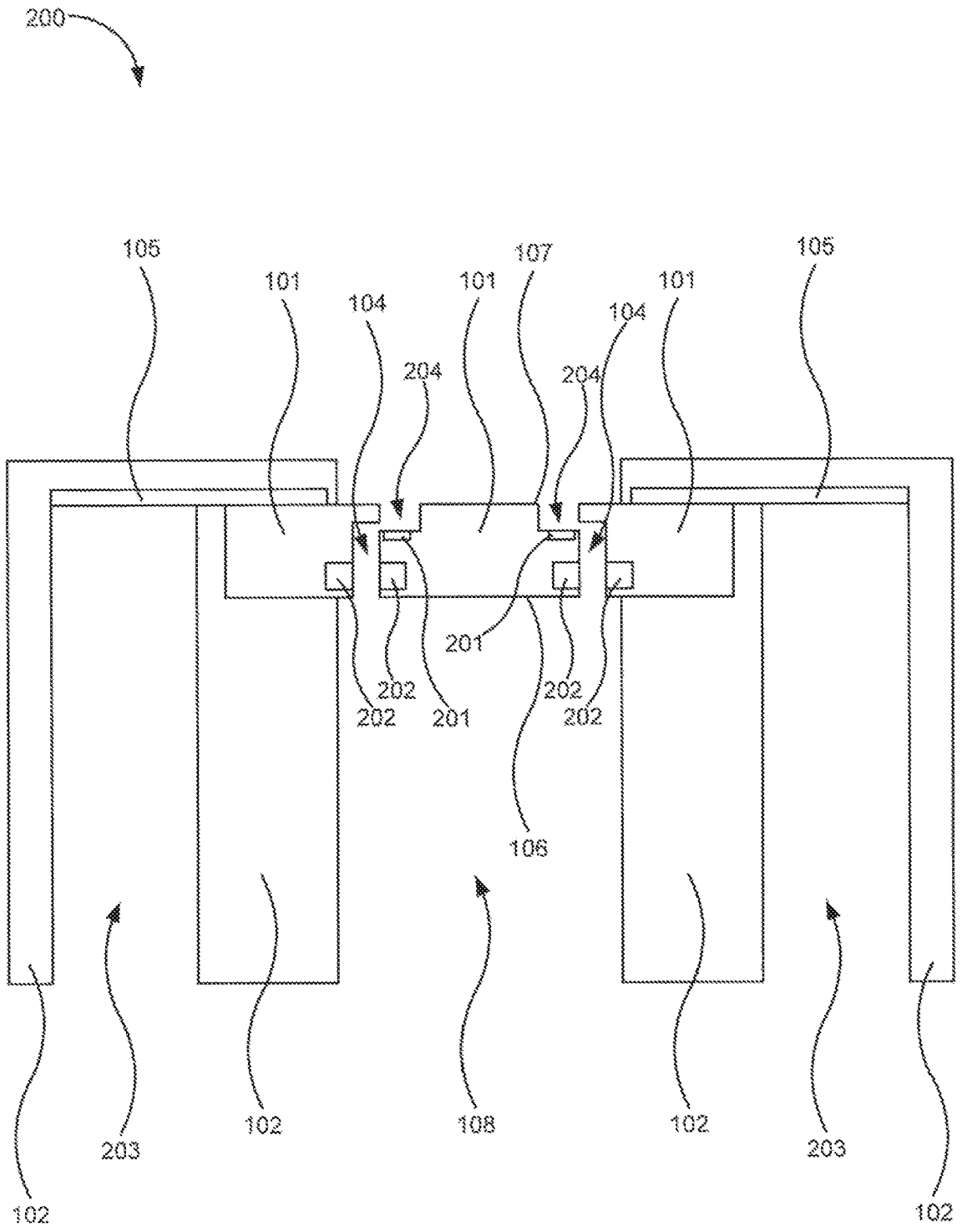
FIG. 2 is an elevation cross-sectional diagram of a fluid flow structure, according to another example of the principles described herein.

FIG. 2 is an elevation cross-sectional diagram of a fluid How structure (200), according to another example of the principles described herein. Those elements similarly numbered in FIG. 2 relative to FIG. 1 are described above in connection with FIG. 1 and other portions herein. A number of fluid ejection chambers (204) and associated ejection resistors (201) are depicted within the fluid ejection die (101) of FIG. 2. The example fluid flow structure (200) of FIG. 2 further includes a number of micro-fluid recirculation pumps (202) as described herein. The micro-fluid recirculation pumps (202) may be located within a fluid passageway within the fluid ejection die (101).

The fluid flow structure (200) of FIG. 2 further includes a number of cooling channels (203) defined within the moldable material (102). The cooling channels (203) may be thermally coupled to the heat exchangers (105) in order to draw heat from the fluid election die (101) via the heat exchangers (105). The moldable material (102) such as an EMC may have a thermal conductivity (i.e., rate at which heat passes through a material) of approximately 2 to 3 watts per square meter of surface area for a temperature gradient of one kelvin for every meter thickness (W/mK). Further, in an example where the moldable material (102) has a filler material such as aluminum oxide ($AlO_3$), its thermal conductivity may be approximately 5 W/mK. In contrast, copper (Cu) and gold (Au) have a thermal conductivity of approximately 410 W/mK and 310 W/mK, respectively. Further silicon (Si) of which the fluid ejection dies (101) may be made of have a thermal conductivity of approximately 148 W/mK. Thus, in order to make the heat exchangers (105) embedded in the moldable material more effective in dissipating heal at least a portion of the heat exchangers (105) may be exposed to the cooling channels (203).

In one example, the cooling channel (203) may transport a cooling fluid therein to assist in drawing the heat away from the fluid ejection die (101). In one example, the cooling fluid may be air passing through the cooling channels (203). In another example, the fluid introduced to the fluid ejection die (101) via the fluid channel (108) and ejected by the fluid ejection chambers (204) and associated ejection resistors (201) of the fluid ejection die (101) is present within the cooling channels (203) and is used as a heat transfer medium.

In still another example, a cooling fluid ether than air or the ejected fluid may be used as the heat transfer medium within the cooling channels (203). In this example, a coolant may be provided which flows through the cooling channels (203) and around the heat exchangers (105) to prevent the fluid election die (101) from overheating. The coolant transfers the heat produced by the resistors within the fluid ejection die (101) to other portions of the fluid flow structure (200) or exterior to the fluid flow structure in order to dissipate the heat. In this example, the coolant may keep its phase and remain as a liquid or gas, or may undergo a phase transition, with the latent heat adding to the cooling efficiency. When a phase transition within the coolant takes place, the coolant may be used to achieve below-ambient temperatures as a refrigerant.

Figure 3:
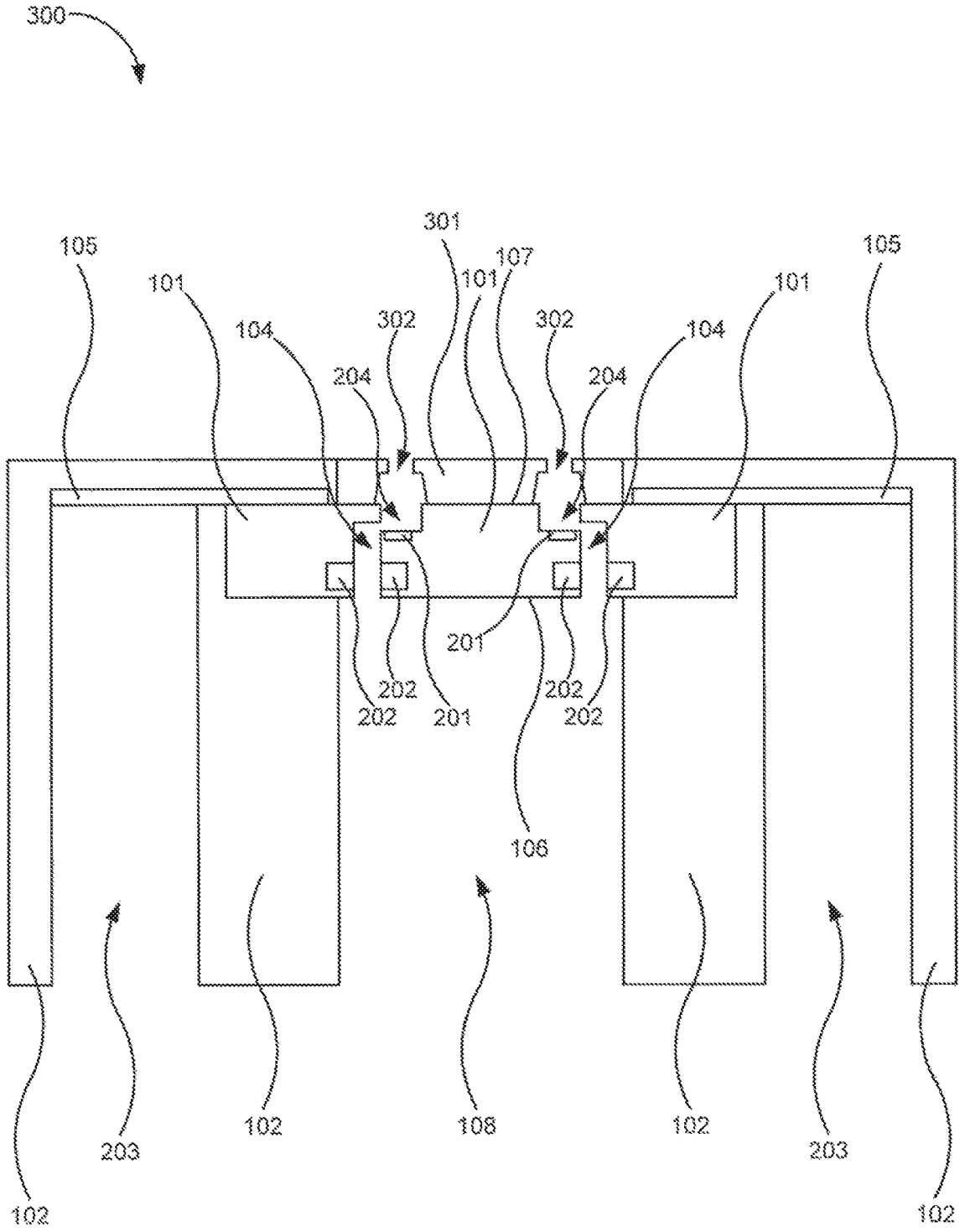
FIG. 3 is an elevation cross-sectional diagram of a fluid flow structure, according to still another example of the principles described herein.

FIG. 3 is an elevation cross-sectional diagram of a fluid flow structure (300), according to still another example of the principles described herein. Those elements similarly numbered in FIG. 3 relative to FIGS. 1 and 2 are described above in connection with FIGS. 1 and 2 and other portions herein. The example of FIG. 3 includes a nozzle plate (301) through which the fluid election die (101) ejects the fluid. The nozzle plate (301) may include a number of nozzles (302) defined in the nozzle plate (301). Any number of nozzles (302) may be included within the nozzle plate (301), and, in one example, each ejection chamber (204) includes a corresponding nozzle (302) defined in the nozzle plate (301).

Figure 4:
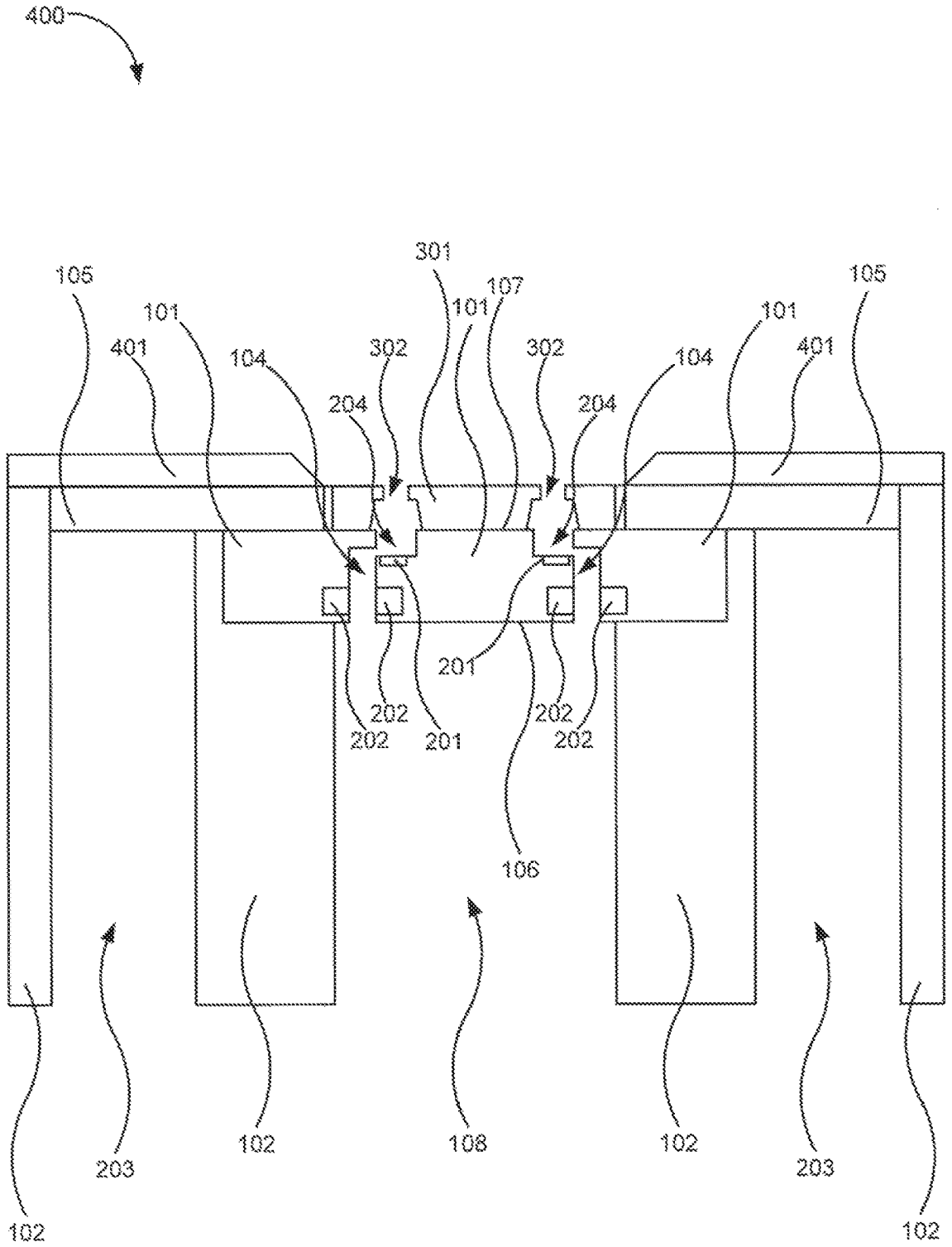
FIG. 4 is an elevation cross-sectional diagram of a fluid flow structure, according to yet another example of the principles described herein.

FIG. 4 is an elevation cross-sectional diagram of a fluid flow structure (400), according to yet another example of the principles described herein. Those elements similarly numbered in FIG. 4 relative to FIGS. 1 through 3 are described above in connection with FIGS. 1 through 3 and other portions herein. The example of FIG. 4 may further include a shroud (401) coupled to an ejection side (107) of the fluid ejection die (101) and thermally coupled to the heat exchangers (105). The shroud (401) may be used to protect the surfaces of the ejection side of the fluid flow structure (100, 200, 300, 400) as well as serve to dissipate heat from the heat exchanger (105), and may be made out of a metal, metal alloy, or other metallic material such as, for example, stainless steel. In this example, the heat exchangers (103) are able to dissipate the waste heat produced by the resistors (201) and the fluid recirculation pumps (202) within the fluid ejection die (101) through the shroud (401) as well as the cooling channels (203). Thus, the shroud (401) may dissipate at least a portion of the heat produced in the fluid ejection die (101) via the heat exchanger (105) to the ambient air around the fluid flow structure (400). In this example, the heat exchangers (105) may be exposed to the ejection side of the fluid flow structure (100, 200, 300, 400) such that the heat exchangers (105) directly contact a surface of the shroud (401). In another example, a thermally conductive grease or other thermally conductive material may be deposited between the heat exchangers (105) and the shroud (401).

Figure 5:
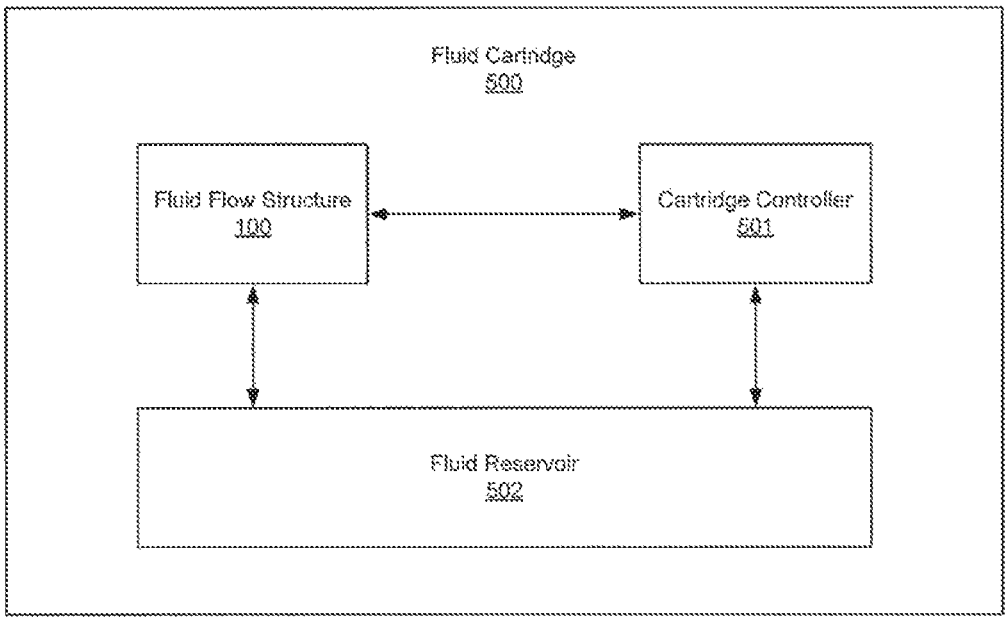
FIG. 5 is a block diagram of a fluid cartridge including a fluid flow structure, according to one example of the principles described herein.

FIG. 5 is a block diagram of a fluid cartridge (500) including a fluid flow structure (100, 200, 300, 400, collectively referred to herein as 100), according to one example of the principles described herein. The fluid flow structure (100) depicted in FIG. 5 may be any of those fluid flow structures described in FIGS. 1 through 4 and throughout the remainder of this disclosure, or combinations thereof. The fluid cartridge (500) may include a fluid reservoir (502), a fluid flow structure (100), and a cartridge controller (501). The fluid reservoir (502) may include the fluid used by the fluid flow structure (100) as an ejection fluid during, for example, a printing process. The fluid may be any fluid that may be ejected by the fluid flow structure (100) and its associated fluid ejection dies (101). In one example, the fluid may be an ink, a water-based ultraviolet (UV) ink, pharmaceutical fluids, and 3D printing materials, among other fluids.

The cartridge controller (501) represents the programming, processors), and associated memories, along with other electronic circuitry and components that control the operative elements of the fluid cartridge (500) including, for example, the resistors (201) and the fluid recirculation pumps (202). The cartridge controller (501) may control the amount and timing of fluid provided to the fluid flow structure (100) by the fluid reservoir (502).

Figure 6:
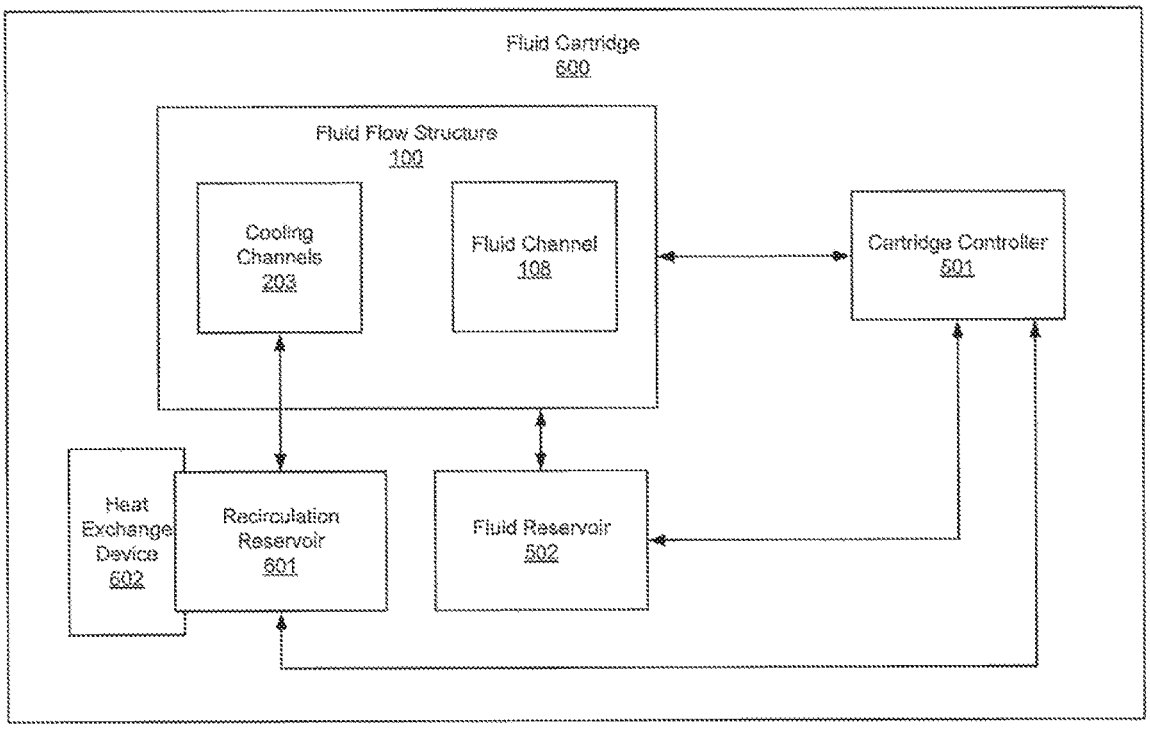
FIG. 6 is a block diagram of a fluid cartridge including a fluid flow structure, according to another example of the principles described herein.

FIG. 6 is a block diagram of a fluid cartridge (600) including a fluid (low structure (100), according to another example of the principles described herein. Those elements similarly numbered in FIG. 8 relative to FIG. 5 are described above in connection with FIG. 5 and other portions herein. The fluid cartridge (600) may further include a recirculation reservoir (601). The recirculation reservoir (601) recirculates a cooling fluid through the cooling channels (203) within the fluid flow structure (100). In one example, the controller may control the recirculation reservoir (601).

Further, in one example, the recirculation reservoir (601) may include a heat exchange device (602) to transfer heat from the cooling fluid within the recirculation reservoir (601). The heat exchange device (602) may be any passive heat exchanger that transfers the heat within the cooling fluid of the recirculation reservoir (601). In one example, the heat exchange device (602) dissipates the heat into ambient air surrounding the recirculation reservoir (601).

In one example, the cooling fluid may be the same as the fluid recirculated within the ejection chambers (204) of the fluid ejection die (101). In this example, the fluid reservoir (502) and the recirculation reservoir (601) may be fluidically such that the fluid within the fluid reservoir (502) is cooled as it is introduced into the recirculation reservoir (601). Further, in this example, the recirculation reservoir (601) may pump the fluid within the fluid reservoir (502) into the cooling channels (203).

In another example, the cooling fluid may be different than the fluid recirculated within the ejection chambers (204) of the fluid ejection die (101). In this example, the fluid reservoir (502) and the recirculation reservoir (601) may be fluidically isolated from one another such that the fluid within the fluid reservoir (502) is introduced to the fluid ejection die (101) via the fluid channel (108), and the cooling fluid within the recirculation reservoir (601) is introduced into the cooling channels (203) via different channels. As described herein, the cooling fluid or coolant may be any fluid that transfers the heat produced by the resistors (201) and fluid recirculation pumps (202) within the fluid ejection die (101) to other portions of the fluid Sow structure (100) or exterior to the fluid flow structure in order to dissipate the heat. In this example, the coolant may keep its phase and remain as a liquid or gas, or may undergo a phase transition, with the latent heat adding to the cooling efficiency. When a phase transition within the coolant takes place, the coolant may be used to achieve below-ambient temperatures as a refrigerant.

Figure 7:
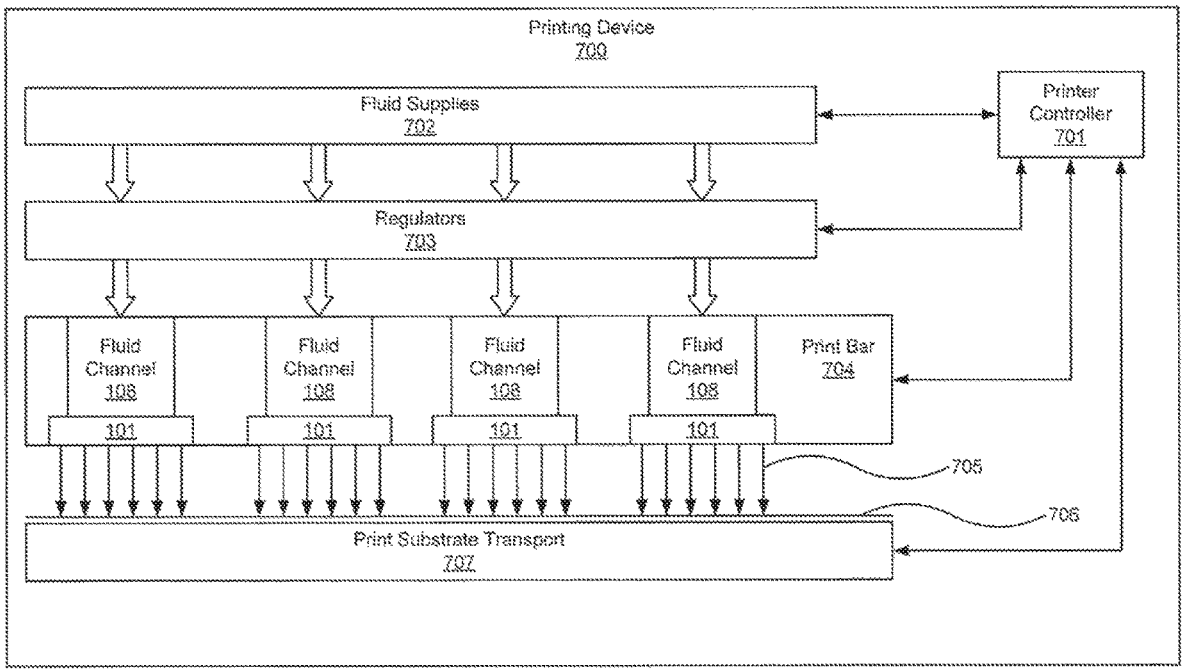
FIG. 7 is a block diagram of a printing device including a number of fluid flow structures in a subside wide print bar, according to one example of the principles described herein.

FIG. 7 is a block, diagram of a printing device (700) including a number of fluid flow structures (100) in a substrate wide print bar (704), according to one example of the principles described herein. The printing device (700) may include a print bar (704) spanning the width of a print substrate (706), a number of flew regulators (703) associated with the print bar (704), a substrate transport mechanism (707), printing fluid supplies (702) such as a fluid reservoir (502), and a controller (701). The controller (701) represents the programming processor(s), and associated memories, along with other electronic circuitry and components that control the operative elements of the printing device (700). The print bar (704) may include an arrangement of fluid ejection dies (101) for dispensing fluid onto a sheet or continuous web of paper or other print substrate (706). Each fluid ejection die (101) receives fluid through a flow path that extend from the fluid supplies (702) into and through the flow regulators (703), and through a number of transfer molded fluid channels (108) defined in the punt bar (704).

Figure 8:
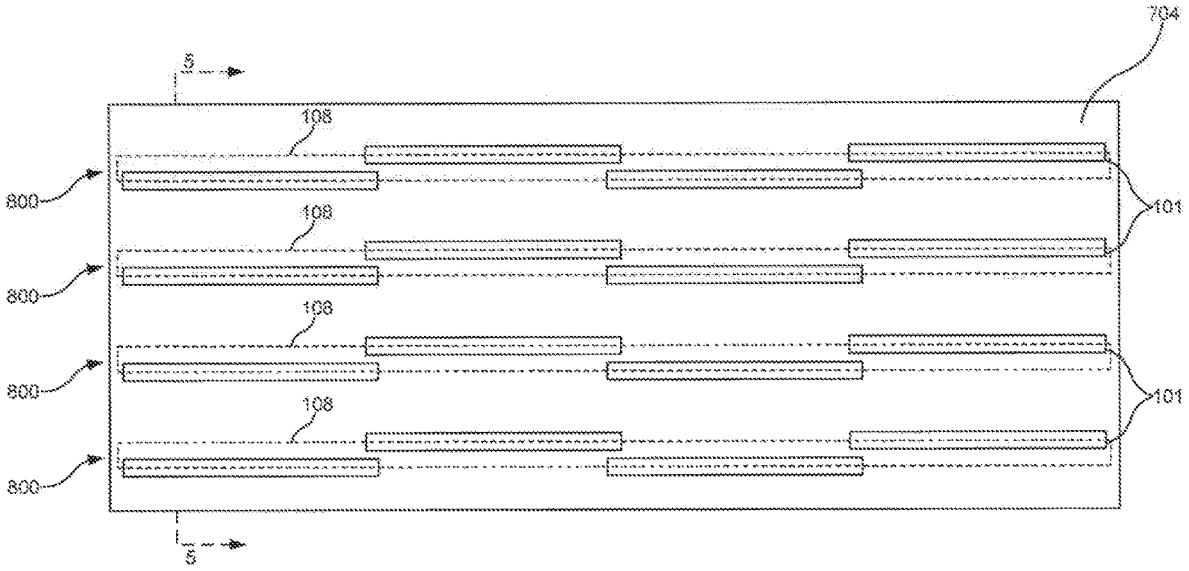
FIG. 8 is a block diagram of a print bar including a number of fluid flow structures, according to one example of the principles described herein.

FIG. 8 is a block diagram of a print bar (704) including a number of fluid flow structures (100), according to one example of the principles described herein. Thus, FIG. 8 illustrates the print bar (704) implementing one example of the transfer molded fluid flow structures (100) as a printhead structure suitable for use in the printer (700) of FIG. 7. Referring to the plan view of FIG. 8, the fluid ejection dies (101) are embedded in an elongated, monolithic molding (102) and arranged end to end in a number of rows (800). The fluid ejection dies (101) are arranged in a staggered configuration in which the fluid election dies (101) in each row (800) overlap another fluid ejection die 102 in that same row (800). In this arrangement, each row (800) of fluid ejection dies (101) receives fluid from a different transfer molded fluid channel (108) as illustrated with dashed lines in FIG. 8. Although four fluid channels (108) feeding four rows (800) of staggered fluid ejection dies (101) is shown for us in, for example, printing four different colors such as cyan, magenta, yellow, and black, other suitable configurations are possible.

Figure 9A:
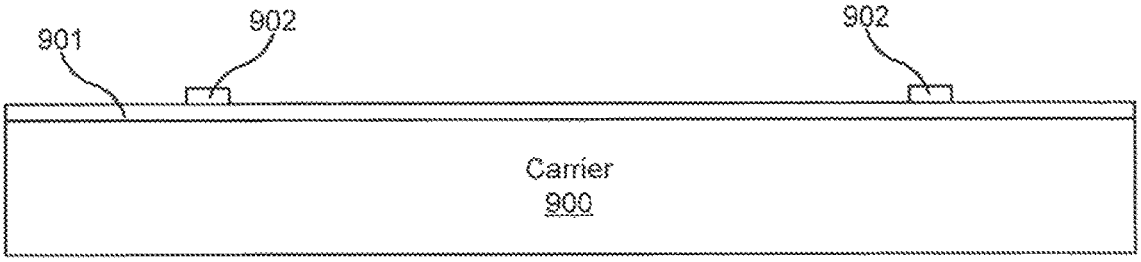
FIGS. 9A through 9E depict a method of manufacturing a fluid flow structure, according to one example of the principles described herein.

FIGS. 9A through 9E depict a method of manufacturing a fluid flow structure (100), according to one example of the principles described herein. Those elements similarly numbered in FIGS. 9A through 9E relative to FIGS. 1 through 8 are described above in connection with FIGS. 1 through 8 and other portions herein. The method may include adhering a thermal release tape (901) or other adhesive to a carrier (900) as depicted in FIG. 9A. A number of standoffs (902) may be formed on the thermal release tape (901). The standoffs (902) may be deposited and cured depending on what type of material the standoffs (902) are made of. In one example, the standoffs (902) ensure that the heat exchanger (105) is not exposed to a surface of the fluid How structure (100) after compression molding the fluid ejection die (101) within the moldable material (102).

Figure 9B:
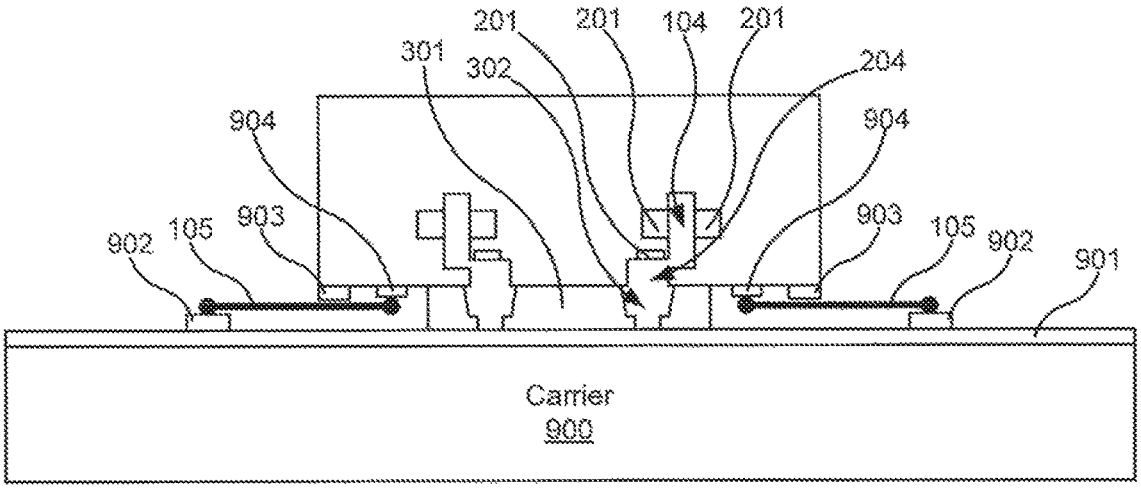
Figure 9C:
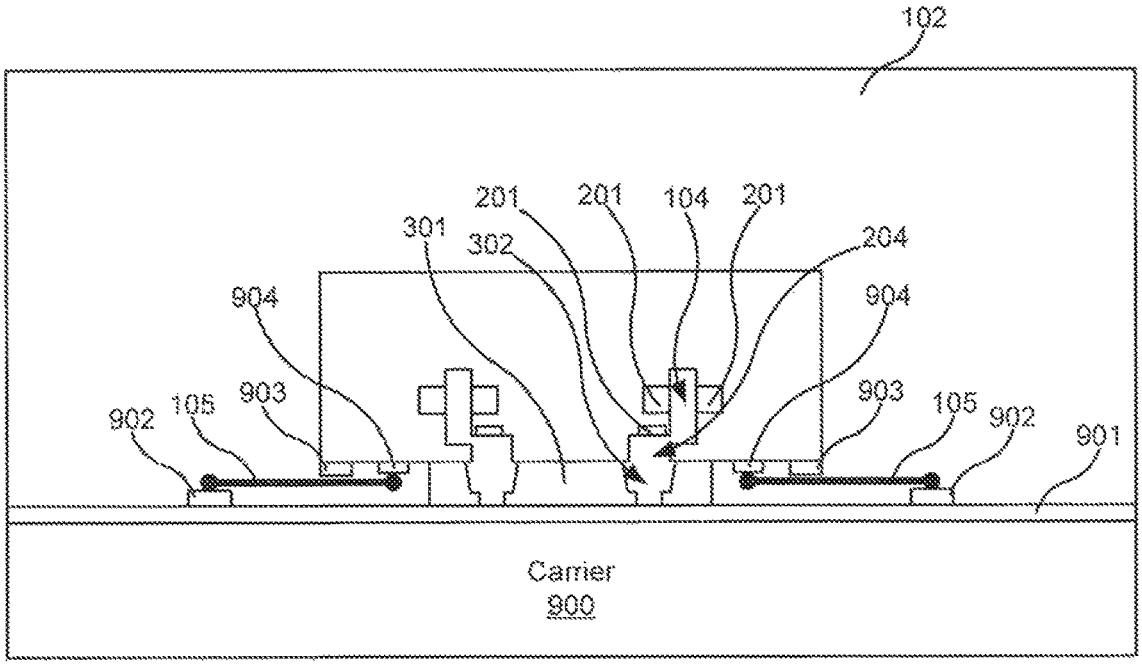

In FIG. 9B, a preprocessed fluid ejection die (101) is coupled to the thermal release tape (901). A race (903) may be formed around a number of bond pads (904) to ensure that the heat exchangers (105) do not come into contact with the fluid ejection die (101) when coupled between the standoffs (902) and the bond pads (904) formed on the fluid ejection die (101). In FIG. 9C, the entirety of the fluid flew structure (100) as depicted in FIG. 9B may be compression overmolded with the moldable material (102).

Figure 9D:
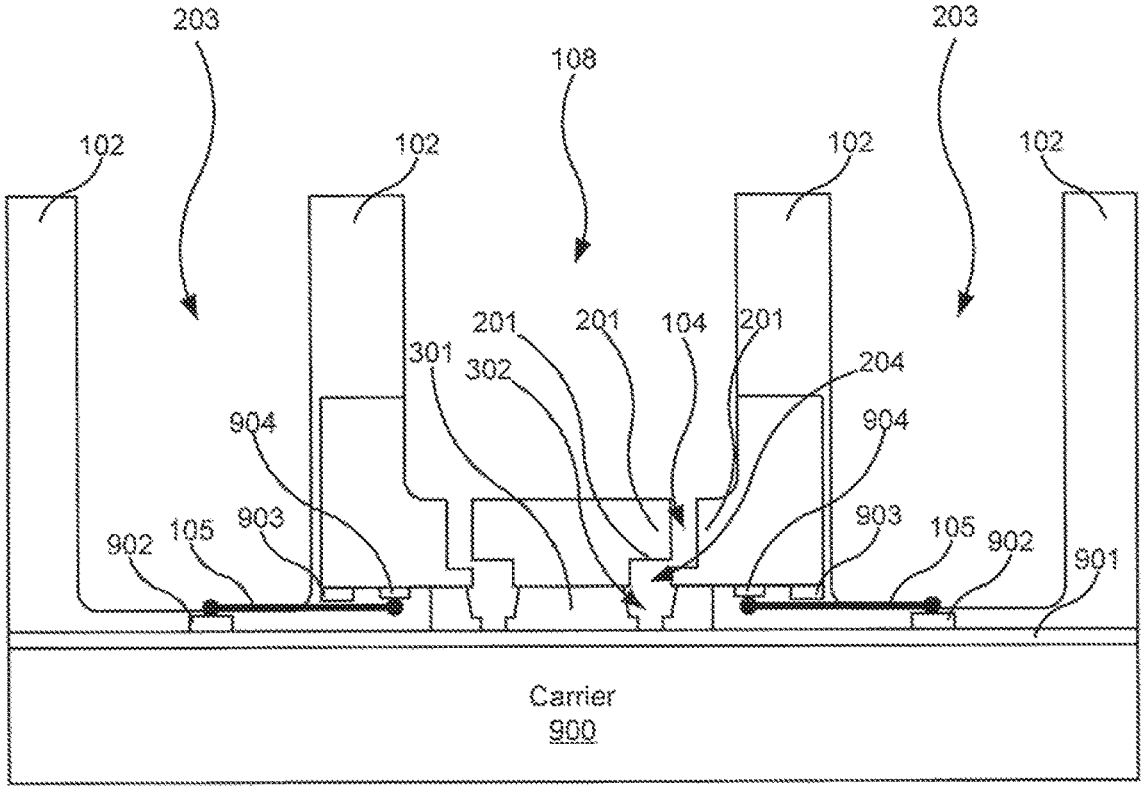
Figure 9E:
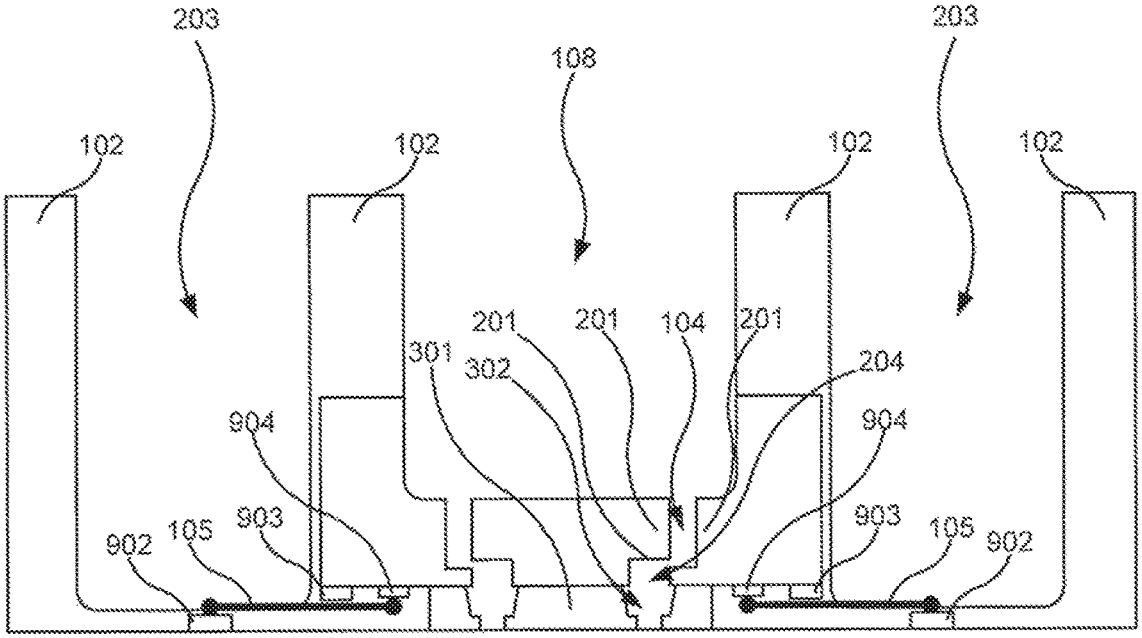

In FIG. 9D, the fluid channel (108) and a number of cooling channels (203) are formed in the moldable material (102). The fluid channel (108) and cooling channels (203) may be formed through a cutting process, laser ablation processes, or other material removal processes. At FIG. 9E, the thermal release tape (901) and carrier (900) are removed exposing the nozzle plate (301) and the coplanar surface of the moldable material (102).

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may fee provided to a processor of a general purpose computer, special purpose computer, or other programmable data processing apparatus to produce a machine, such that the computer usable program code, when executed via, for example, the printer controller (701) of the printing device (700), the cartridge controller (501) of the fluid cartridge (500, 600), or other programmable data processing apparatus, or combinations thereof implement the functions or acts specified in the flowchart and/or block diagram block or blocks. In one example, the computer usable program code may be embodied within a computer readable storage medium; the computer readable storage medium being pad of the computer program product. In one example, the computer readable storage medium is a non-transitory computer readable medium.

The specification and figures describe a fluid ejection device. The fluid ejection device may include a fluid ejection die embedded in a moldable material, and a number of heat exchangers thermally coupled to an ejection side of the fluid ejection die. Further, the fluid ejection device may include a number of cooling channels defined in the moldable material thermally coupled to the heat exchangers. This fluid ejection device reduces or eliminates pigment settling and decap when printing high solid electable fluids such as inks which may otherwise prevent proper printing at start up. Micro-recirculation of the fluid within the fluid ejection die solves the pigment settling and decap issues, and the heat exchangers and cooling channels reduce or eliminate thermal defects during printing caused by waste heat generated by the micro-fluid recirculation pumps.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluid ejection device comprising:

a fluid ejection die embedded in a moldable material;

a number of fluid actuators within the fluid ejection die;

a number of heat exchangers thermally coupled to an ejection side of the fluid ejection die; and a number of cooling channels defined in the moldable material thermally coupled to the heat exchangers.

2. The fluid ejection device of claim 1, wherein the heat exchangers comprise a wire, a bend ribbon, a heat pipe, a lead frame, or combinations thereof.

3. The fluid ejection device of claim 1, wherein the fluid actuators comprise a number of fluid recirculation pumps within the fluid ejection die to recirculate fluid within a number of ejection chambers of the fluid ejection die, wherein the fluid recirculated by the fluid recirculation pumps within the ejection chambers of the fluid ejection die is present within the cooling channels.

4. The fluid ejection device of claim 1, wherein the cooling channels convey a cooling fluid, the cooling fluid functioning to transfer heat from the heat exchangers.

5. The fluid ejection device of claim 1, wherein the heat exchangers are embedded within the moldable material, and exposed to the cooling channels.

6. The fluid ejection device of claim 1, further comprising a shroud coupled to an ejection side of the fluid ejection device and thermally coupled to the heat exchangers.

7. A print bar comprising:

a fluid ejection device comprising:

a fluid ejection die embedded in a moldable material;

a number of fluid recirculation pumps within the fluid ejection die to recirculate fluid within a number of ejection chambers of the fluid ejection die;

a number of heat exchangers at least partially embedded within the moldable material and thermally coupled to an ejection side of the fluid ejection die; and a number of cooling channels defined in the moldable material thermally coupled to the heat exchangers.

8. The print bar of claim 7, further comprising a recirculation reservoir for recirculating a cooling fluid through the cooling channels.

9. The print bar of claim 8, wherein the recirculation reservoir comprises a heat exchange device to transfer heat from the cooling fluid.

10. The print bar of claim 7, further comprising a controller to:

control ejection of the fluid from the fluid ejection die; and control the fluid recirculation pumps.

11. The print bar of claim 10, wherein the cooling fluid is the same as the fluid recirculated within the ejection chambers of the fluid ejection die.

12. The print bar of claim 10, wherein the cooling fluid is different than the fluid recirculated within the ejection chambers of the fluid ejection die.

13. A fluid flow structure, comprising:

a sliver die compression molded into a molding;

a fluid feed hole extending through the sliver die from a first exterior surface to a second exterior surface;

a fluid channel fluidically coupled to the first exterior surface; and a number of heat exchangers at least partially molded info the molding and thermally coupled to the second exterior surface of the fluid ejection die.

14. The fluid flow structure claim 13, further comprising a shroud coupled to the ejection side of the fluid ejection device and thermally coupled to the heat exchangers.

15. The fluid flow structure claim 13, further comprising a number of cooling channels defined in the moldable material thermally coupled to the heat exchangers.

* * * * *